United States Patent [19]

Hickling

[11] 3,973,232

[45] Aug. 3, 1976

[54] ADJUSTABLE THERMALLY-RESPONSIVE CIRCUIT-BREAKING DEVICE

[75] Inventor: Colin D. Hickling, Woodstock, N.Y.

[73] Assignee: American Thermostat Corporation, South Cairo, N.Y.

[22] Filed: May 30, 1975

[21] Appl. No.: 582,257

[52] U.S. Cl. ..... 337/94; 337/346; 337/360

[51] Int. Cl.[2] ..... H01H 61/08

[58] Field of Search ..... 337/37, 82, 84, 94, 337/346, 349, 360, 362, 368, 374

[56] References Cited

UNITED STATES PATENTS

| | | | |
|---|---|---|---|
| 2,716,175 | 8/1955 | Franklin | 337/349 X |
| 3,366,756 | 1/1968 | Watson | 337/360 X |
| 3,913,048 | 10/1975 | Mertler | 337/360 X |

*Primary Examiner*—George Harris

[57] ABSTRACT

A thermally-responsive circuit-breaking device with an adjustable temperature set-point. The device is provided with a thermally-responsive element controlling an electric switch. In one embodiment, the temperature set-point is dependent on the width of a gap between respective portions of the element and the switch. One of the portions is a surface inclined away from and engagable by the other portion. By adjustably positioning the element and switch relative to one another the portions are aligned to engage at different points along the inclined surface to thereby vary the gap. In the other embodiment, the switch and the element have respective overlapping and engaging portions with the temperature set-point being dependent on the amount of overlap. As the element moves in response to temperature change in a given sense, the overlapping portions slide over each other until at one position of the element the overlap is eliminated causing the switch to open. One of the overlapping portions is contoured so as to alter the amount of overlap as the element and switch are adjustably positioned relative to one another.

21 Claims, 7 Drawing Figures

FIG. 1
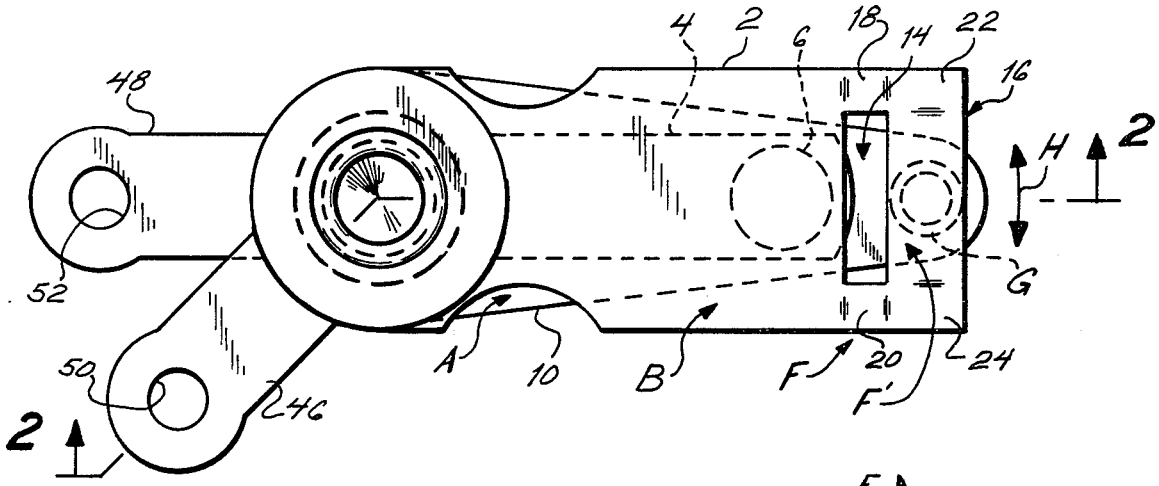
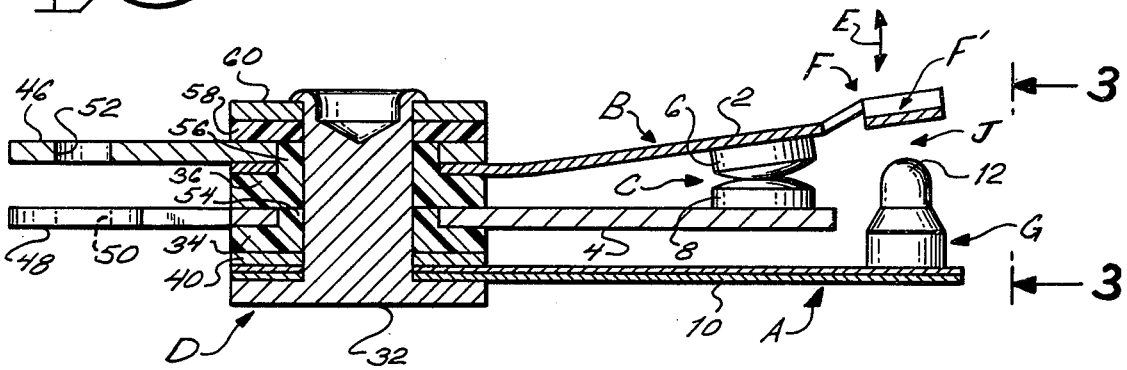
FIG. 2
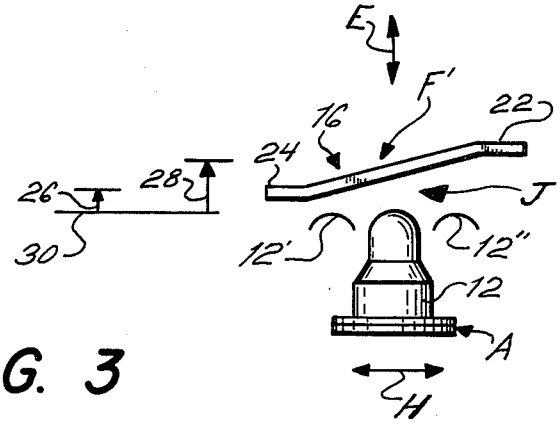
FIG. 3

FIG. 5
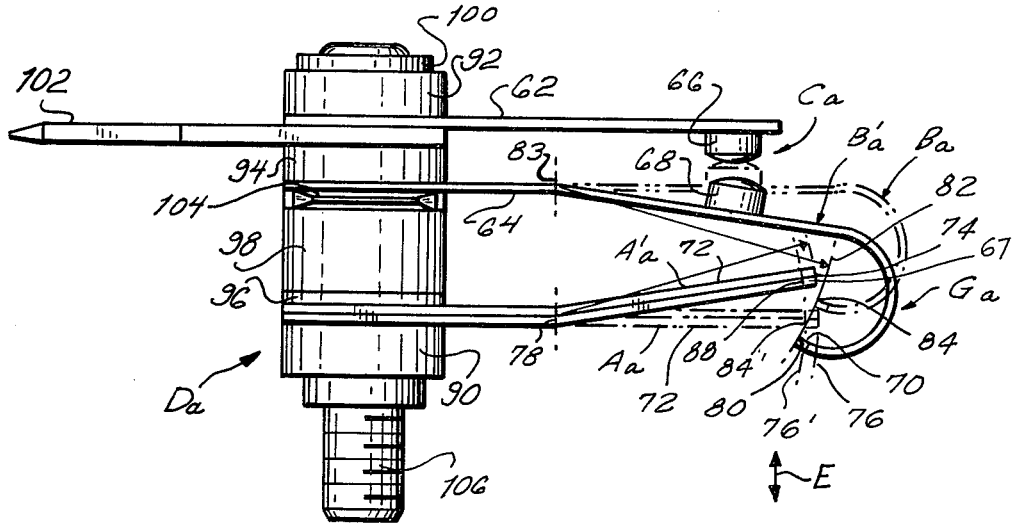
FIG. 6
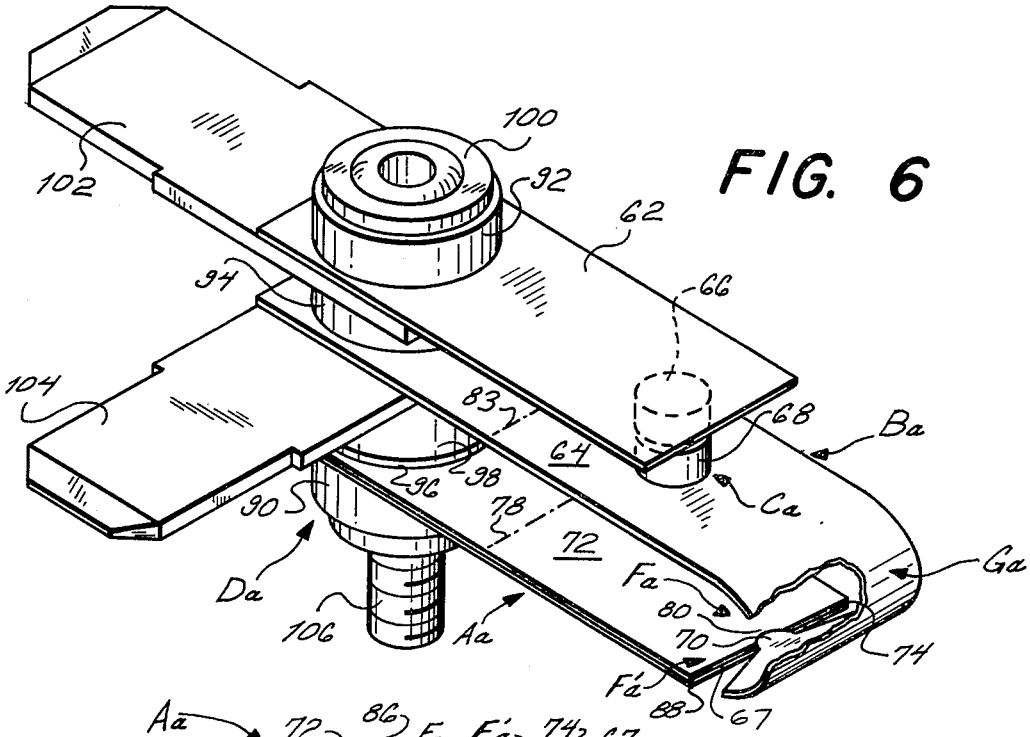
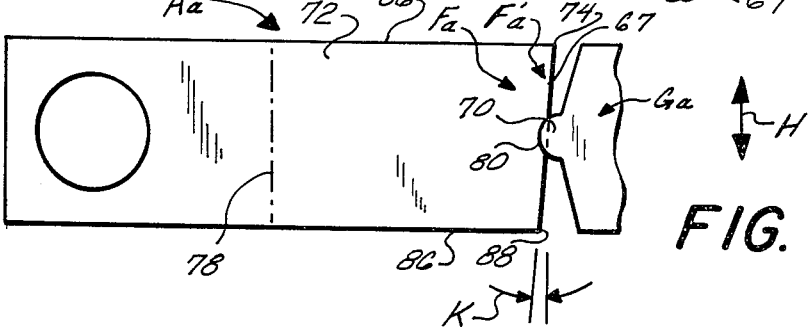
FIG. 7

ADJUSTABLE THERMALLY-RESPONSIVE CIRCUIT-BREAKING DEVICE

The invention is directed to a novel arrangement for adjusting the temperature set-point of a thermally-responsive circuit-breaking device.

The adjustability of a thermally-responsive circuit-breaking device provides it with a versatility that is of benefit to both manufacturer and user. Since such a device is designed to function within a certain temperature range, the manufacturer does not need to provide a line of devices to cover different temperatures within each range. Also, production is simplified since every component can be mass produced which, in turn, lowers the cost of each component. Furthermore, maintaining an inventory is greatly simplified by virtue of the necessity to stock a much smaller number of parts. The user benefits in that he has a convenient means of setting the temperature set-point in usages which require different set-points at various times. Also, should a set-point be required for which no non-adjustable devices are conventionally available the user would have to purchase one that is made to order, at additional expense. An adjustable device, on the other hand, can be precisely calibrated to any temperature required. Furthermore, adjustable devices are transferrable from one usage to another usage, if so desired, even when different temperature setpoints are required for each usage.

Since adjustability of the temperature set-point has long been recognized to be of significant value, many devices have been developed which provide such a feature. However, the means for varying a temperature set-point incorporated into the prior art devices have been relatively complex, inaccurate, unreliable, and expensive. Many of these adjustable devices are variations of the well-known blade thermostat which closes an electric circuit with a resilient blade biased to normally close a contact switch. A bimetal blade responds to a temperature change in a given sense to move the resilient blade so as to open the switch at a pre-set temperature. If the bimetal blade is positioned so that it need move only a short distance from a disengaged position at some reference temperature (hereinafter termed "reference position") before engaging the resilient blade the switch will be opened at a lower temperature than if the bimetal blade has a greater distance to traverse. In other words, the temperature set-point varies as a function of the distance, or gap, between the resilient blade and the bimetal blade when the latter is at the reference position. Although the pre-set temperature is dependent on such other factors as the bias on the resilient blade and the characteristics of the bimetal, the width of the gap is the most convenient to control. A screw is often used to vary this gap by moving the bimetal blade away from the resilient blade or vice versa. Inaccuracies are inherent with such an arrangement because of a degree of wobble in the screw threads. Also, since a screw and its corresponding threaded hole are particularly subject to wear, accuracy of the device deteriorates with usage. Furthermore, since a screw is liable to turn in response to vibration, reliability of the device for certain usages is inadequate. Therefore, such an arrangement for adjusting the temperature set-point is unreliable and inaccurate. In those arrangements where a screw is not used, other parts, such as cams, are used to vary the gap and to maintain the desired gap setting. Common to all of these arrangements is the fact that parts, in addition to those forming the thermostat, must be used to provide adjustability of the set-point. Since these parts are manufactured only within a certain manufacturing tolerance, the resultant inaccuracy adds to the overall inaccuracy of the device. Furthermore the device is necessarily bulkier and costlier.

It is a general object of the invention to provide a thermally-responsive circuit-breaking device with an adjustable temperature set-point.

It is a more specific object of the present invention to provide an adjustable thermally-responsive circuit-breaking device that is simple, compact, reliable, accurate and inexpensive.

It is a further object of the present invention to provide a thermally-responsive circuit-breaking device requiring no additional parts to permit adjustability of the temperature set-point.

In accordance with these objects, two embodiments of an adjustable thermally-responsive circuit-breaking device are disclosed, in both of which adjustable relative positioning of the generally conventional parts ordinarily required in the device produces the temperature adjustment. The first embodiment is based on the conventional bladetype thermostat wherein the resilient blade normally maintains a switch closed. A thermally-responsive element, such as a bimetal blade, is separated from the resilient blade by a gap which it traverses in response to a given temperature change to engage the resilient blade and move it away from its normal position, thereby opening the switch. One of the blades is provided with a contact surface which is inclined at an angle to the direction moved by the bimetal blade in response to a temperature change in a given sense. By shifting the blades relative to each other in a direction other than that moved in response to temperature change the point of contact between the blades is moved along the inclined surface thereby changing the gap that must be traversed by the bimetal to engage the resilient blade and open the switch. The other embodiment is illustrated as producing adjustability in a thermally-responsive circuit-breaking device of the type disclosed in application No. 512,497 filed Oct. 7, 1974 in the name of Colin D. Hickling. This device is a non-resettable circuit-breaking device in which the switch is closed when an end portion of a resilient element overaps and engages the end portion of a thermally-responsive element such as a bimetal. As the bimetal moves in response to a given temperature change the edges of the respective overlapping end portions slide toward each other to gradually reduce the overlap. Since the resilient element is biased away from the bimetal it snaps away from the bimetal when the end portions no longer overlap to open the switch. The edge of one end portion is so angled as to change the overlap at a given temperature as one element is moved relative to the other in a direction other than that moved by the bimetal in response to a temperature change. In both embodiments the set-point is, thus, adjustable by virtue of this relative movement between the elements and without requiring any extra parts.

To the accomplishment of the above, and to such other objects as may hereinafter appear, the present invention relates to the construction of an adjustable thermally-responsive circuit-breaking device as defined in the appended claims and as described in this specification, taken together with the accompanying drawings, in which:

FIG. 1 is a top plan view of the first embodiment of the invention;

FIG. 2 is a sectional view along line 2—2 in FIG. 1;

FIG. 3 is a view along line 3—3 in FIG. 2;

FIG. 5 is a side elevational view of the second embodiment;

FIG. 6 is a perspective view of the second embodiment with the parts assembled as in FIG. 5 and with the movable parts positioned as shown by the dotted lines in FIG. 5;

FIG. 7 is a fragmentary view showing how the resilient element contacts and overlaps the thermally-responsive element.

Figure 4:
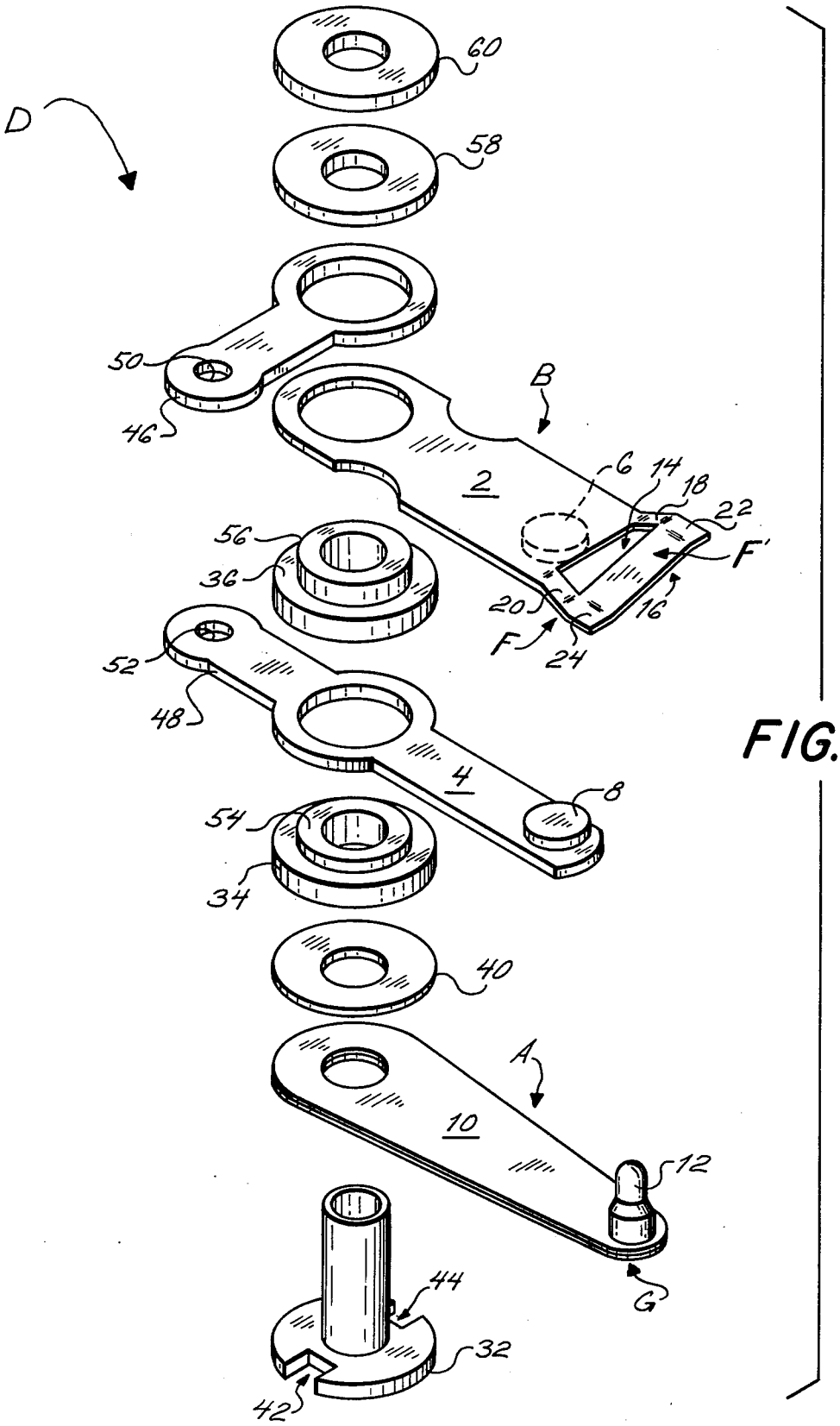
FIG. 4 is a perspective view of the aligned but unassembled parts of the second embodiment.

Every thermally-responsive device requires a minimum number of movable parts essential to its proper operation. Each movable part added to this minimum number in order to provide a certain function detracts from the device in some manner because of increased expense or bulk or because the inherent inaccuracies in every movable part reduce the overall reliability and accuracy of the device. Consequently, the ideal arrangement to maximize the quality of performance of the device is to provide this certain function without resort to extra parts. Both embodiments of the invention are directed to this end and therefore utilize only those parts normally essential to proper operation of the device apart from the temperature adjustment feature. Adjustability of the temperature set-point, which is the additional function made available by the present invention, is provided by modifying an essential part and thus no additional parts of any consequence are needed.

In both embodiments of the present invention, a thermally-responsive element A, a resilient element B and an electrical switch C are secured to a support D. The condition of switch C is dependent on the position of element B, with switch C being normally closed. As the temperature changes, element A moves in direction E and its motion is transmitted to element B by an end portion F on one of the elements which engages the corresponding portion G on the other element. At some point along direction E, element A causes element B to reach the position where switch C is opened by element B. To provide an adjustable temperature set-point, element A is made movable in direction H relative to element B and a surface F′ of end portion F is inclined at an angle to directions E and H. As the element A is shifted in direction H, a different portion of inclined surface F′ is engaged by portion G and consequently the point along direction E at which element B causes switch C to open is varied.

Turning now more particularly to a specific description of FIGS. 1–4 related to the first embodiment, electrical switch C comprises arms 2 and 4 carrying contacts 6 and 8. Switch arm 2 is flexible while switch arm 4 is preferably rigid. The switch is opened and closed by moving flexible arm 2 to engage and separate the contacts. Arm 2 is a part of element B which also comprises end portion F extending beyond arms 2 and 4. Movement of arm 2 is caused by thermally-responsive element A, which is preferably a bimetal strip 10, having an insulator button 12 extending up from its free end and adapted to engage end portion F of element B.

Switch arms 2 and 4 and bimetal 10 are suitably mounted in a stack on support D in a conventional manner. At a particular reference temperature, such as room temperature, contacts 6 and 8 are engaged since arm 2 is biased toward arm 4. The position of bimetal 10 is such as to leave a gap at J between button 12 and end portion F of element B. This gap has a given value at the reference temperature and is variable as bimetal 10 moves in direction E in response to a decrease or an increase in temperature. Direction E is shown by a double ended arrow to indicate response of the bimetal to a temperature change in either sense. As the temperature increases, bimetal 10 moves in the upward direction E until button 12 engages end portion F of element B. Any further increase will result in the movement of bimetal 10 being transmitted to switch arm 2 to cause separation of contacts 6 and 8. The temperature at which contacts 6 and 8 separate to break the circuit is called the temperature set-point. Up to this point, the thermostat assembly is completely conventional.

In order to provide an adjustable temperature set-point, the regular structure of conventionally used resilient element B is altered. As pointed out above, the most convenient variable to control in a blade thermostat in order to adjust the temperature set-point is the gap width at J. End portion F of resilient element B is designed to provide this adjustable gap width. An inclined surface F′ is formed as part of end portion F, which is significantly wider than button 12, by cutting out a rectangular area 14 leaving a section 16 adjoining one side of area 14. Section 16 is thus attached to arm 2 only by sections 18 and 20 at either end of area 14. By bending sections 18 and 20 in opposite directions, end 22 of section 16 being above switch-arm 2 and end 24 of section 16 being below switch-arm 2, inclined surface F′ is formed. Any well-known technique, such as stamping, can be used to so shape end portion F.

Since surface F′ of resilient element B is inclined away from button 12 on bimetal blade 10, the gap width at J is dependent on the relative lateral or rotational alignment of surface F′ and button 12. As best seen in FIG. 3, the gap width at J is at a minimum, thereby providing a minimum temperature set-point, with button 12 aligned to engage end 24 of section 16, while a maximum gap width, and thereby a maximum temperature set-point, is attained by positioning button 12 in alignment with end 22. A particular temperature within the range of the device can be preset by positioning button 12 in alignment with a particular point along the inclined surface F′. Thus, button 12 is shown in FIG. 3 to be in position for a temperature set-point approximately in the middle of this range while positions 12′ and 12″ set gaps 26 and 28 for lower and higher temperature set-points, respectively. Gaps 26 and 28 are based on the distance of inclined surface F′ from line 30 representing the position of bimetal 10 at a reference temperature such as room temperature.

The gap width at J is varied simply by moving bimetal 10 in direction H relative to element B. Direction H refers to either of the oppositely facing arrows. As best seen in FIG. 1, such movement aligns button 12 with any desired point along inclined surface F′. As the temperaure inceases, bimetal 10 will bend in the upward direction E until button 12 engages that portion of surface F′ with which it is aligned. Of course, the smaller the gap separation at J the smaller the temperature change necessary to attain this engagement. An additional incremental temperature increase will cause the conventional separation of contacts 6 and 8 by virtue of transmission of the movement of bimetal 10 to switch-arm 2 through the engaged surfaces, as discussed above.

Switch-arms 2 and 4 and bimetal 10 are mounted in a stack on the shank of supporting rivet 32 of support D and properly aligned. During usage, however, the preset alignment can be undesirably altered due to vibration, for example. Also, the inclination of surfce F′ results in a force component in a direction H as bimetal 10 moves element B in direction E to open and reclose switch C during normal operation of the thermostat. Consequently, a tight stack is preferred. However, some movement of elements A and B relative to each other in direction H is necessary to provide adjustability of the temperature set-point. Either or both of elements A and B can be made movable. If element B were made movable, its movement would have to be accompanied by a corresponding movement of arm 4 to keep contacts 6 and 8 aligned. Since a minimum number of moving parts generally produces maximum accuracy, movement of element A to provide adjustability is preferred since it alone need be moved. Therefore, the movement of arms 2 and 4 in the stack is purposefully hindered not only by the tight riveting but by the relatively rough surfaces of washers 34 and 36, preferably made of ceramic, with which they are in contact. In contrast, movement of the bimetal is relatively facilitated by placing it between the metal surfaces of rivet 32 and metal washer 40. Movement of bimetal 10 can be accomplished, for example, by providing a part (not shown) integral with it protruding outside of the housing (not shown). In the preferred embodiment, notches 42 and 44, shown in FIG. 4, are provided in rivet 32. These fit on a special holder (not shown) to keep the device stationary while a special tool (not shown) is used to move the bimetal in direction H.

Terminal lugs 46 and 48 are in contact with arms 2 and 4, respectively. Terminal lug 48 is preferably made integral with arm 4 to reduce the number of parts used. Lugs 46 and 48 have holes 50 and 52, respectively, adapted to receive electrical leads connected to the load.

Washers 34 and 36 are preferably made of ceramic and have an upwardly protruding ring 54 and 56, respectively, along their inside radius. Ring 54 serves to electrically insulate current conductive arm 4 from rivet 32. Otherwise, a hazardous current path would exist to rivet 32 which is conventionally exposed outside of the housing (now shown) in order to serve as the mount for the thermostat. Anyone touching rivet 32 would be, thus, liable to receive an electrical shock. Furthermore, without this insulation the load might be shorted since current might flow through rivet 32 to an extraneous point rather than through terminal lug 48 to the load. Ring 56 separates arm 2 and lug 4 from rivet 32 for the same electric-shock-preventative reason. To complete the stack, a washer 58, made from a non-conductive material such as ceramic, is placed between lug 46 and a metal washer 60. Rivet 32 is riveted to metal washer 60 which protects ceramic washer 58 from breakage due to the riveting.

It should be noted that although inclined surface F′ has been shown in FIG. 3 as linear, any curve can be used for a particular purpose, such as to compensate for non-linearities in the bimetal. Also, the location of inclined surface F′ and button 12 can be reversed to be located on thermally-responsive element A and resilient element B, respectively. It is only their relative positions, rather than the particular elements to which they are attached, that is significant. Also, the adjustable temperature range of the thermostat can be varied by, for example, changing the angle of inclination of surface F′ or the width of end portion F.

The second embodiment, shown in FIGS. 5–7, is illustrated in connection with a non-resettable thermally-responsive circuit-breaking device disclosed in the aforementioned application No. 512,497. The same letters followed by an "a" will be used in describing this embodiment to denote those parts having features common to both embodiments. Switch $C_a$ comprises arms 62 and 64 carrying contacts 66 and 68. Arm 64 is resilient and biased away from arm 62 which, preferably, is also resilient. Switch $C_a$ is opened and closed by moving arm 64 to engage and separate the contacts. Arm 64 is a part of element $B_a$ having an end portion $G_a$ which is reentrant. A protrusion 70 is at the edge of end portion $G_a$. Switch $C_a$ is closed and the device readied for its thermally-responsive operation by manually placing protrusion 70 in overlapping engagement with end portion $F_a$ of element $A_a$ as shown by dotted line portions $A_a$ and $B_a$, respectively in FIG. 5. Thermally-responsive element $A_a$ is preferably a bimetal strip 72 which is in the position $A_a$ at a reference temperature, such as room temperature. Bimetal 72 moves in direction E in response to temperature change. A double ended arrow is used for direction E to indicate movement of bimetal 72 in response to both a decrease and an increase in temperature. As the temperature increases, bimetal 72 will bend in the upward direction E and its corner edge 74 will consequently move in an arc 76 around effective center 78. This movement will cause a corresponding movement of element $B_a$, with tip 80 of protrusion 70 following an arc 82 around effective center 83. Since arcs 76 and 82 intersect, protrusion 70 will slide on end portion F until only the very tips of protrusion 70 and end portion F (represented for the present by corner edge 74) are engaged at the point of intersection 84. An additional incremental change in temperature will result in element $B_a$ snapping away from bimetal 72 to its unbiased position, shown by solid lines $B_a'$. In this position of element $B_a$, contacts 66 and 68 are separated, opening switch $C_a$. Such is the normal operation of this device and more specific details as to its structure and operation can be found in the aforementioned application No. 512,947, which disclosure is incorporated herein.

It should be apparent from the above description that the point at which the resilient element $B_a$ snaps away from bimetal 72, or the temperature set-point, is dependent on the amount of overlap between protrusion 70 and end portion F. The greater the overlap the greater is the bending of bimetal 72, and the higher the temperature, that is required before element $B_a$ can snap away to cause opening of switch $C_a$. To allow adjustability of the overlap, and therefore of the temperature set-point, the conventional structure of bimetal 72 is altered. Whereas the standard form of bimetal 72 is rectangular, in the present invention end surface $F_a'$ of end portion $F_a$ has an edge 67 forming an acute angle K with sides 86 of the bimetal. By moving bimetal 72 in one of the directions H, indicated by the double ended arrow, a different portion of surface $F_a'$ is aligned with protrusion 70 thereby varying the amount of overlap. Thus, for example, should protrusion 71 be aligned with corner edge 88 of bimetal 72, which moves in an arc 76′ around effective center 78, blade $B_a$ will snap away from bimetal 72 at the point 84′. Point 84′ is closer to the reference position $A_a$ of bimetal 72 than the point of intersection 84 related to alignment of corner edge 74 with protrusion 70. Consequently, switch $C_a$ will be opened at a lower temperature corresponding to corner edge 88 than to corner edge 74. Of course, any temperature within the range of the device can be preset by aligning protrusion 70 with any point along surface $F_a'$.

Switch-arms 62 and 64 and bimetal 78 are mounted in a stack on rivet 90 of support D. A tight stack is preferred to prevent undesirable misalignment of the various parts, as discussed above in description of the first embodiment. However, relative movement of elements $A_a$ and $B_a$ is necessary to provide an adjustable temperature set-point. Movement of element A to provide this feature is preferred since only it alone need by moved. On the other hand, movement of element $B_a$ would have to be accompanied by corresponding movement of switch-arm 62 to keep contacts 66 and 68 engaged. Movement of switch-arms 62 and 64 is therefore hindered not only by the tight stack but also by the relatively rough surfaces of washers 92 and 94, preferably made of ceramic, with which they are in contact. In contrast, bimetal 72 is mounted between the metal surfaces of rivet 90 and metal washer 96 to relatively facilitate its movement in direction H. Non-conductive washer 98, preferably made of ceramic, and washer 94 have protruding rings similar to rings 54 and 56 in the first embodiment for the safety reasons discussed above. Rivet 90 is riveted to metal washer 100 to tighten the stack. Terminal lugs 102 and 104 are in contact with arms 62 and 64, respectively, to carry current to the load. The threaded portion of 106 of rivet 90 is used to mount the device onto the apparatus it is designed to protect, but other mounting means can be used as well.

The shape of protrusion 70 and its location on element $B_a$ are merely illustrative. Any shape can be used as long as its width is small in comparison to that of angled surface $F_a'$. Likewise angled surface $F_a'$ need not be linear and can be made in any one of many different shapes, the only essential factor being the variability of overlap between it and protrusion 70. Also, the adjustable temperature range of the device can be changed by, for example, varying the width of surface $F_a'$ and/or the angle K. Furthermore, the structure for shifting elements $A_a$ and $B_a$ relative to one another on the support D discussed in relation to the first embodiment can be used here as well.

It will be apparent from the foregoing that advantages of the present invention are achieved simply and economically by shaping one conventionally used element of a thermally-responsive circuit-breaking device so that its adjustable positioning relative to the rest of the device in a direction other than that moved by the movable parts in response to temperature change provides an adjustable temperature set-point. The adjustability of this device is, thus, attained without the need for additional parts since the element used to provide this feature is one necessary to the operation of the non-adjustable device as well.

While but two embodiments of the present invention have been here specifically disclosed it will be apparent that many variations may be made therein all within the scope of the instant invention as defined in the following claims:

I claim:

1. In an adjustable thermally-responsive circuit-breaking device comprising: switch means positionable in open-circuit and closed-circuit conditions, a thermally-responsive member movable in a first direction in response to change of temperature, and means operatively connecting said thermally-responsive member to said switch means for opening and closing the latter in response to movement of the former, the improvement which comprises:

means mounting said switch means and said thermally-responsive member for relative adjustable positioning in a second direction different from said first direction, means sensitive to said relative adjustable positioning and effective to modify the action of said connecting means in response to the sensed relative positioning so as to cause said switch means to be shifted from one of its conditions to the other at different points along said first direction for different of said relative positionings.

2. The device of claim 1, wherein said mounting means is comprised of a support, with said switch means and said thermally-responsive member being fastened to said support and adapted to be shifted relative to one another in said second direction.

3. The device of claim 1, wherein said first direction and said second direction are substantially perpendicular.

4. The device of claim 1, wherein said means for modifying the action of said connecting means is comprised of a surface section and a part engagable with said surface, said surface section being operatively connected to one of said switch means and said temperature sensitive member, said engagable part being operatively connected to the other, and wherein at least a portion of said surface section extends at an angle to said first direction and to said second direction, said part engaging different points along said angled surface portion for different of said relative positions.

5. The device of claim 4, wherein said mounting means is comprised of a support, with said switch means and said thermally-responsive member being fastened to said support and adapted to be shifted relative to one another in said second direction.

6. The device of claim 4, wherein said surface has an edge forming an angle with said second direction and wherein said engagable part is comprised of a means slidably engaged with said surface and adapted for movement towards said edge in response to movement of said thermally-responsive member in said first direction.

7. The device of claim 4, wherein said surface section and said engagable part overlap, said part adapted to be slidably engaged to eliminate said overlap in response to movement of said member in said first direction, said means for modifying the action of said connecting means comprising means for varying said overlap for different of said relative positionings at a given temperature.

8. The device of claim 7, wherein said overlap varying means is comprised of an edge of said surface forming an angle with said second direction, said part being adapted to slide toward said edge.

9. The device of claim 1, wherein said means for modifying the action of said connecting means is comprised of a surface section and a part engagale with said surface, said surface section being operatively connected to one of said switch means and said temperature sensitive member, said engagable part being operatively connected to the other, and wherein a locus of said relative positionings defines a plane, said surface being inclined with respect to said plane.

10. An adjustable thermally-responsive circuit-breaking device, comprising:

a support;

a pair of contacts mounted on said support for movement between open-circuit and closed-circuit conditions;

a pair of members mounted on said support, at least one of said members being operatively connected to one of said contacts, one of said members being thermally-responsive and movable in a first direction in response to temperature change, one of said members being adjustably positionable relative to the other in a second direction different from but not opposite to said first direction; and engagable means operatively connected to said members respectively and effective to transmit motion of said temperature-sensitive member to the other member at least until the former reaches a predetermined point along said first direction, said contacts being shifted from one condition to the other by said at least one of said members at said point, said means being sensitive to the relative positions of said members in said second direction and effective to vary the location of said predetermined point in response to said sensed relative position, whereby said contacts are placed in open-circuit condition at different of said points in said first direction for different such relative positions of said members.

11. The device of claim 10, wherein at least one of said members is rotatably adjustable on said support in said second direction.

12. The device of claim 10, wherein said engagable means is comprised of a surface section operatively connected to one of said members and a part engagable with said surface operatively connected to the other of said members and wherein at least a portion of said surface section extends at an angle to said first direction and to said second direction.

13. The device of claim 11, wherein said first direction and said second direction are substantially perpendicular to each other.

14. The device of claim 12, wherein a locus of said relative positions defines a plane, said surface being inclined with respect to said plane.

15. The device of claim 10, wherein the engagable means is effective to transmit motion of said temperature sensitive member to said other member along said first direction for a distance which varies in response to said sensed relative position.

16. The device of claim 15, wherein said part is slidably engaged with said surface and adapted to move along a sliding direction toward an edge of said surface during movement of said thermally-responsive member in said first direction, said edge forming an acute angle with said first direction and with said second direction.

17. The device of claim 12, wherein said surface section and said part overlap and are slidably engaged so as to reduce the overlap in response to movement of said thermally-responsive member in said first direction, said engagable means further comprising means to vary said overlap for different of said relative positions.

18. The device of claim 17, wherein said overlap varying means is comprised of an edge surface with said part being adapted to slide toward said edge, said edge forming an angle with said first and said second direction.

19. An adjustable thermally-responsive circuit-breaking device comprising a support;

a pair of contacts mounted on said support for movement between open-circuit and closed-circuit conditions;

a pair of members mounted on said support, at least one of said members being operatively connected to one of said contacts, at least one of said members being thermally-responsive and movable in a first direction in response to temperature change, one of said members being adjustably positionable relative to the other in a second direction different from said first direction, and said members being engagable with one another, for movement-transmission from said thermally-responsive member to the other of said members to effect placing of said contacts in open-circuit position, along a surface on one of said members at least a portion of which extends at an angle to said first direction and to said second direction, said members being engagable at different points along said angled portion for different of said relative positions, whereby the adjustable position of said one of said members relative to the other varies the amount of movement of said thermally-responsive member in said first direction which is effective to place said contacts in open-circuit condition.

20. The device of claim 19, wherein one of said contacts is mounted on said support and the other of said contacts is mounted on said other member, and wherein said surface is inclined at an angle to a plane defined by a locus of said relative positions.

21. The device of claim 19, wherein said members have respective end portions, said surface comprising one of said respective end portions, the other of said respective end portions being adapted for overlapping and slidably engaging said surface for movement toward an edge of said surface in response to movement of said thermally-responsive member in said first direction, said edge forming an angle with said first direction and said second direction.

* * * * *